United States Patent [19]

Boesl et al.

[11] Patent Number: 5,032,722

[45] Date of Patent: Jul. 16, 1991

[54] MS-MS TIME-OF-FLIGHT MASS SPECTROMETER

[75] Inventors: Ulrich Boesl, Landshut; Edward W. Schlag, Munich; Klaus Walter, Weilheim; Rainer Weinkauf, München, all of Fed. Rep. of Germany

[73] Assignee: Bruker Franzen Analytik GmbH, Fed. Rep. of Germany

[21] Appl. No.: 541,140

[22] Filed: Jun. 20, 1990

[30] Foreign Application Priority Data

Jun. 23, 1989 [DE] Fed. Rep. of Germany ..... 3920566

[51] Int. Cl.[5] ..... E01D 59/44; H01J 99/10

[52] U.S. Cl. ..... 250/287; 250/286; 250/281; 250/282

[58] Field of Search ..... 250/287, 286, 281, 282

[56] References Cited

U.S. PATENT DOCUMENTS

| | | | |
|---|---|---|---|
| 4,072,862 | 2/1978 | Mamyrin et al. | 250/287 |
| 4,458,149 | 7/1984 | Muga | 250/287 |
| 4,694,168 | 9/1987 | Beyec et al. . | |
| 4,731,532 | 3/1988 | Frey et al. | 250/287 |
| 4,733,073 | 3/1988 | Becker et al. | 250/287 |
| 4,818,862 | 4/1989 | Conzemius . | |

FOREIGN PATENT DOCUMENTS

| | | |
|---|---|---|
| 89/06044 | 12/1988 | Int'l Pat. Institute . |
| 1302193 | 4/1969 | United Kingdom . |

OTHER PUBLICATIONS

Mamyrin et al., Zh. Eksp. Teor. Fiz. 65 (1973) 82.
Boesl et al., Anal. Instrum. 16, (1987) 151.
Grotemeyer et al., Org. Mass Spectrom. 21 (1986) 645.
Boesl et al., J. Chem. Phys. 72 (1980) 4327.
Boesl et al., Chem. Phys. Lett. 87 (1982) 1.
U. Boesl, H. J. Neusser, R. Weinkant. E. W. Schlag, J. Phys. Chem. 86 (1982) 4857.
D. Price and G. J. Milnes, Intern. Journ. of Mass Spectrometry and Ion Process, 60 (1984) 61–81.
Gary L. Glish and Douglas E. Goeringer, Anal. Chem., 1984, 56, 2291–2295.
W. C. Wiley and I. H. McLaren, The Review of Scientific Instruments, vol. 26 No. 12, 1150–1157, Dec. 1955.
V. I. Karataev, B. A. Mamyrin and D. V. Shmikk, Soviet Physics-Technical Physics, vol. 16 No. 7, 1177–1179, Jan. 1972.
Makoto et al., Rev. Sci. Instrum. 59(9), Sep. 1988, 1947–1950.
Bergmann et al., Rev. Sci. Instrum. 60(4), Apr. 1989, 792.

*Primary Examiner*—Jack I. Berman
*Assistant Examiner*—Jack I. Nguyen
*Attorney, Agent, or Firm*—Walter A. Hackler

[57] ABSTRACT

In an MS-MS time-of-flight mass spectrometer, a space focus of the ion source is defined by correction of the second order. If the geometrical and electric values of the ion source are suitably selected, the space focus may be such as to permit very good primary mass resolution when suitable secondary interaction methods are used. The secondary interaction at the space focus may be effected (a) by a focused, pulsed laser ray or other pulsed interaction methods that can be focused. (b) by a wire mesh consisting of very fine "line combs" engaging each other, to which voltage pulses can be applied, (c) by a combination of a) and/or b) with an electrostatically high, primary, fieldless drift path. The MS-MS time-of-flight mass spectrometer is operated using a reflector comprising a movable reflector end plate with adjustable potential, which enables primary ions to be eliminated from the spectrum without any loss in mass resolution. By tuning the reflector fields in a suitable manner, and suitable selection of an observation window in the time-of-flight spectrum, it is possible to measure a secondary mass spectrum generated at the space focus.

16 Claims, 5 Drawing Sheets

Figure 1:
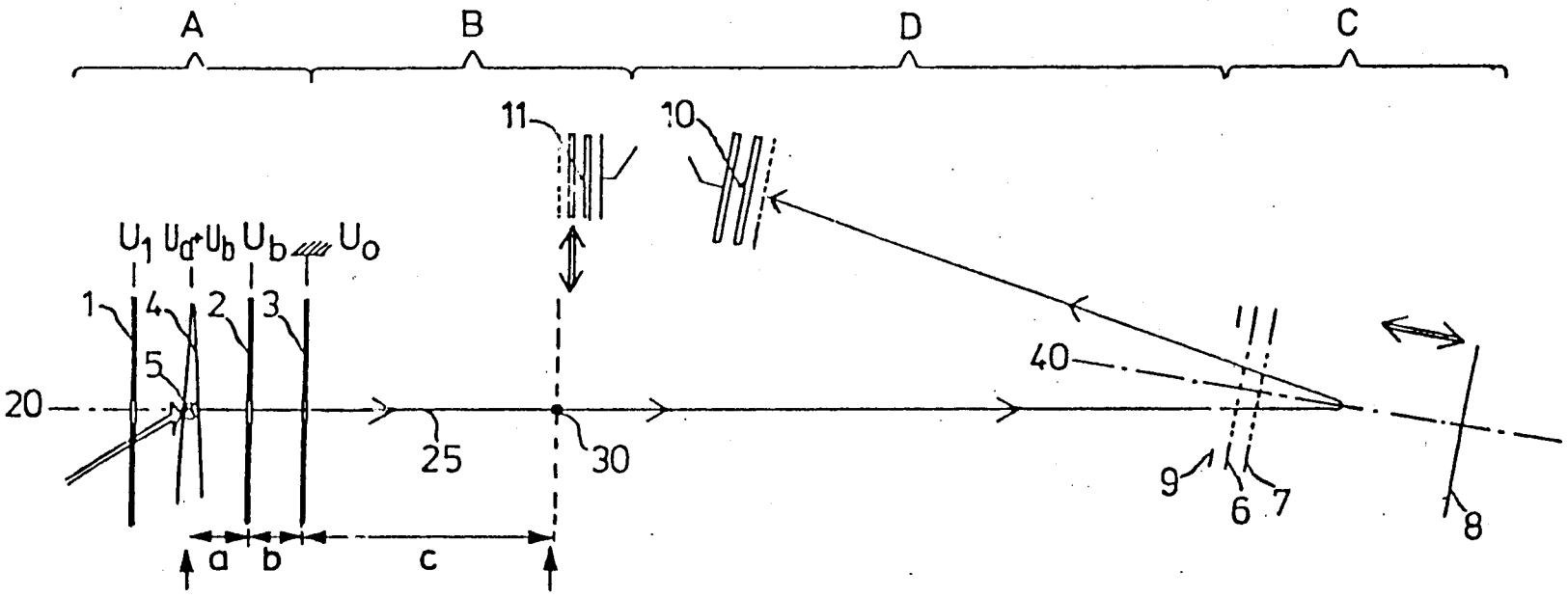

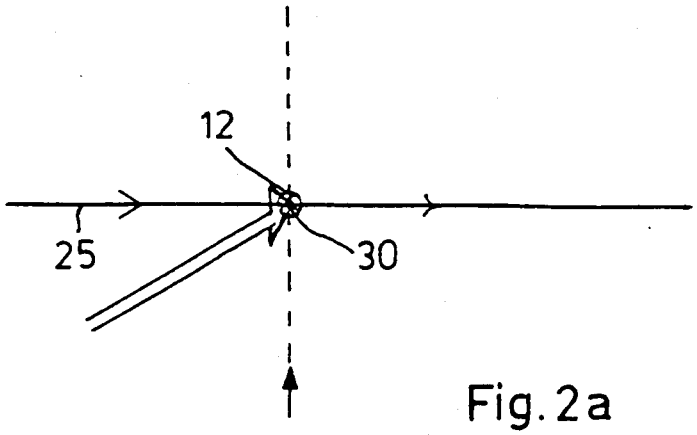
Fig. 2a
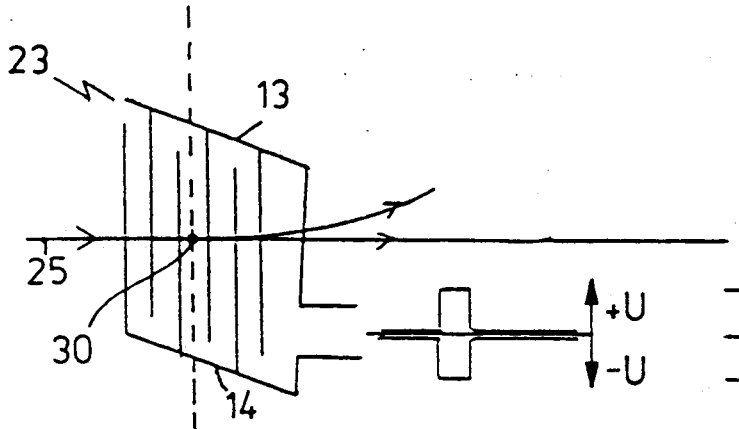
Fig. 2b
Fig. 2c
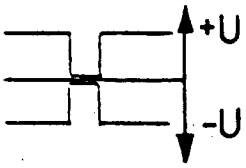
Fig. 2d
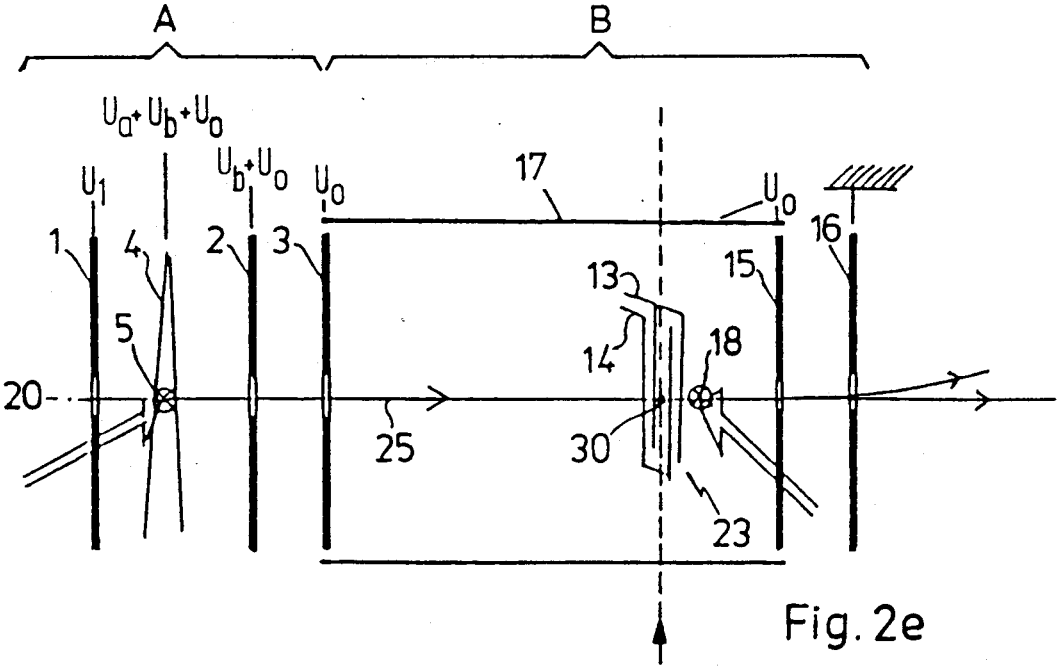
Fig. 2e

MS-MS TIME-OF-FLIGHT MASS SPECTROMETER

The present invention relates to a time-of-flight mass spectrometer comprising an ion source for generating a pulsed primary ion beam, a device for influencing the ions intermittently, in sharply defined areas, and an ion reflector for balancing out time-of-flight differences between ions of identical mass.

The use of MS-MS techniques in mass spectrometry allows a secondary mass selection to be effected after a preferred mass has been selected from the diversity of ions produced by the ion source, by means of a primary mass selector. If following this primary selection the selected ions are subjected to subsequent interactions of various kinds (such as excitation by collision, light, etc.) leading to fragmentation, then the secondary fragments can be examined by an additional mass analysis process. Such MS-MS techniques may be employed for investigations of molecular decay kinetics, for gaining information on molecular structures and for analyzing unknown molecules; they are one of the most complex methods in this field, but on the other hand one providing a maximum of information.

In MS-MS mass spectrometry, one usually makes use of so-called double-focussing devices which consist of a combination of magnetic and electrostatic mass analyzers. These conventional MS-MS devices, just as the further improved MS-MS-MS devices, have reached certain limits with respect to their development possibilities, as regards both their cost/performance relation and their technical possibilities.

The so-called reflectron time-of-flight spectrometers (see for example Mamyrin et al., Zh. Eksp. Teor. Fiz. 64 (1973) 82) have overcome one of the most important disadvantages of conventional time-of-flight mass spectrometers: The low degree of mass resolution. Reflectrons are capable of achieving a resolution (50%—Tal) of 5,000 as standard (without readjustment) and of 10,000 without serious problems (see for example: Boesl et al., Anal. Instrum. 16 (1987) 151). Even a resolution of 35,000 has already been achieved (T. Bergmann, T.P. Martin, H. Schaber Rev. Sci. Instrum. 60 (1989) 347). On the other hand, the outstanding advantage of time-of-flight mass analyzers, namely their extraordinarily high transmission, and, thus, detection efficiency, remains practically unaffected.

Resonant laser excitation serves for ionizing molecules by multi-photon (in most of the cases two-photon) absorption, via a resonant intermediate state. The inclusion of a molecule-specific resonant optical transition enables already selective substances to be ionized, thus representing a first step toward MS-MS methods. However, resonant laser excitation also distinguishes itself by a high degree of flexibility: On the one hand, it permits extraordinarily gentle ionization (see for example Grotemeyer et al., Org. Mass Spectrom. 21 (1986) 645), frequently even without any fragmentation, while on the other hand it also provides the possibility to achieve fragmentation, which in addition can be varied from the generation of only a few fragments with many metastable decays to—on the other hand—extremely hard fragmentation (see for example Boesl et al., J. Chem. Phys. 72 (1980) 4327 and Chem. Phys. Lett. 87 (1982) 1).

The combination of resonant laser excitation and modern time-of-flight mass spectrometry (U. Boesl, H.J. Neusser, R. Weinkant, E.W. Schlag, J. Phys. Chem. 86 (1982) 4857) leads to a new type of mass spectrometer, the so-called laser time-of-flight mass spectrometer. Resonant laser time-of-flight mass spectrometry is at present at the very beginning of its development. Neither the ion-optical possibilities provided by the time-of-flight analyzer nor their combination with the properties specific to laser ionization, such as short pulses, extremely low excitation volume, variation of wavelength and intensity, have been fully exploited to this day.

Now, it is the object of the present invention to provide a device composed of simple components and providing different options, which enables an additional mass selection and/or secondary fragmentation step to be carried out following an ionization step and before the final time-of-flight mass analysis, and which is not inferior to known devices as regards the aspects of mass resolution, transmission and detection efficiency.

This object is achieved according to the invention by an arrangement in which the ion source is designed in such a way that all ions of the same mass, which are generated by the ion source at the same time, but at different points, and which therefore have different kinetic energies, arrive simultaneously at a space focus of the 2nd order, in which the space focus is equipped with means by which the physical state of the ions can be subjected intermittently to at least one of the following changes, namely change of the pulse, change of the quantum-mechanical state of the electron envelope, chemical reaction or fragmentation, so that a secondary ion beam with new physical properties is produced from the primary ion beam, and in which the design of the ion reflector is such that operation in a corresponding mode will lead to secondary ions of the same mass being time focused and the primary ions being screened out.

Thanks to the exact definition of the space focus, in particular of the 2nd or a higher order, one obtains a point in space where extremely high primary mass resolution is rendered possible. A secondary interaction exactly at this space focus will, therefore, provide a secondary mass spectrum with extremely favorable starting conditions. The nature of the secondary interaction is initially without importance and may be selected at discretion. The ion reflector arranged downstream finally permits optimum mass resolution, by time focussing, of the secondary mass spectrum so obtained, in particular if the reflector is tuned specifically to the secondary ion masses of interest.

Compared with conventional MS-MS devices, the MS-MS time-of-flight spectrometer according to the present invention offers the advantages of high transmission and, thus, high detection efficiency and of very high rapidity. Commercially available reflectron time-of-flight spectrometers can be converted to an MS-MS device by minor changes, the most important additional expenses being due to the particular selected, secondary interaction method and remain far below the purchase price of the original unit. As in simple time-of-flight mass spectrometers, high transmission and detection efficiency are also intrinsic properties of the method, just as the rapidity: Secondary mass spectra can be run in the submilliseconds range without losses in transmission or mass resolution. For collision activation, the method can be combined with practically any interaction method, such as laser excitation, electron, ion, molecular and atomic ray or gas chambers.

The exact definition of the space focus, i.e. the point of optimum energy correction of the primary ions leaving the ion source, is an essential requirement for the operation of the time-of-flight mass spectrometer according to the invention. While heretofore no energy correction, or at best energy corrections of the 1st order, were effected at the space focus, the ion source now proposed, which is obtained by adhering to the distance relationships between the diaphragms, and the corresponding potential relationships specified in claim 2, permits an energy correction of the 2nd order. In certain embodiments of the ion source according to the invention, the particles to be ionized may be made available simply by introducing gas into the ion source, or by vaporizing the particles in the ion source. The latter method is suited also for examining solid substances.

According to another embodiment of the invention, the particles to be examined are introduced into the ion source by means of an atomic or molecular ray so that the particles to be ionized are contained in a narrow defined spacial area which permits the point of ion generation to be exactly defined. The atomic or molecular ray may intersect the axis of symmetry of the diaphragms at a substantially right angle between the first and the second diaphragm of the ion source, at a distance a from the second diaphragm. According to other embodiments of the invention, however, the atomic or molecular ray enters the ion source through the first diaphragm in a direction colinear to the axis of symmetry of the diaphragms so that the additional devices for generating the atomic of molecular ray need not be arranged laterally of the mass spectrometer, but may be located on the imaginary extension of the axis of the spectrometer. Another advantage of this arrangement resides in the fact that the particles have a ray characteristic in the direction of the ion ray to be formed later, already before being ionized.

The ionization in the ion source of the particles to be examined may be effected either by photo effect, by particle collision or by field ionization. According to certain embodiments of the invention which make use of photo ionization, the residual energy in the molecule ion can be kept very low in the ionization process. This is a "gentle" ionization method which permits also very sensitive large molecules to be ionized without bursting. The cheapest method consists in the use of a light ray from an incoherent source, in particular a UV source, for example a mercury vapor lamp, for the continuous generation of a high luminous power, or of commercially available flash lamps. According to other embodiments of the invention, pulsed or continuous laser beams are used for photo ionization of the particles to be examined. The extraordinarily high degree of frequency definition of laser light permits a high degree of atom or molecule-specific selectivity to be achieved for the photo ionization process. It is thus possible to select only specific particles from a particle mixture supplied by the ion source. According to certain embodiments of the invention, pulsed lasers are used whose time characteristics are impressed to the pulsed ion beam. Another advantage provided by the use of lasers resides in the high power density that can be achieved by it, the possibility to achieve very sharp special bundling of the laser rays, with the resulting very exact definition of the point of generation of the ions, and the utilization of the sharp frequency definition of the laser light in view of the optical excitation of the particles to be examined.

According to certain embodiments of the time-of-flight mass spectrometer according to the &invention, the particles to be examined are ionized by collision using a beam of charged particles. This particle beam may be an electron beam in case high ray intensities and good spacial beam definition can be achieved at low cost and in a simple manner, for example by means of a hot cathode and simple electron optics. According to other embodiments of the invention, collision ionization is effected by means of an ion beam which enables ion collision processes in the ion source to be examine mass spectroscopic means.

The use of rays for making available the particles to be examined on the one hand, and for the quanta effecting the ionization on the other hand, results in particularly sharp definition of the point of generation of the ions, being the point of intersection of the two rays.

According to certain embodiments of the invention, the pulse characteristics of the ion beam are produced by pulsed potentials at the diaphragms of the ion source whereby continuous supply of the particles to be examined and continuous ionization are rendered possible. According to other embodiments of the invention, the potentials are applied to the diaphragms statically which permits the use of considerably simpler electronics for the voltage supply to the diaphragms, but which requires a pulsed ionizing ray. In order to enable the ion ray to be adjusted both in space and energetically, the potentials applied to the diaphragms of the ion source can be adjusted separately according to certain embodiments of the invention.

Exact adjustment of the space focus is achieved by displacing the ionizing ray and/or the atomic or molecular ray, and by varying the potential applied to the diaphragms of the ion source. According to certain embodiments of the invention, control means are provided for adjusting the potential $U_b$ prevailing at the second diaphragm automatically to given spacings a, b, c and a given potential $U_1$, existing at the first diaphragm.

According to certain embodiments of the time-of-flight diaphragm spectrometer, an ion detector having a plane impact surface is provided in the path of movement of the ions at a distance c behind the third diaphragm of the ion source, viewed in the direction of flight of the ions, by means of which the position of the space focus can be exactly defined. According to one particular embodiment, the ion detector can be moved out of the path of movement of the ions by mechanical displacement means which permits the properties of the space focus to be utilized either by recording a mass spectrum at the space focus, or else the ion detector can be moved out of the ion ray, after completion of the adjustment of the space focus to permit a secondary interaction at the space focus.

According to certain embodiments of the invention the secondary action on the ion ray at the space focus is effected with a defined time delay, relative to the time of generation of the ion pulses at the ion source. In order to enable the energy-correcting properties of the space focus to be utilized optimally, action on the ions at the space focus is taken in a sharply defined manner, geometrically. Thus, the space focus is the point of origin of a secondary mass spectrum. In the case of a pulsed secondary action on the ion ray, the pulse initiating the interaction is synchronized with the primary ion pulse from the ion source.

According to one embodiment of the invention, influence is taken on the ions by building up a pulsed electric field in transverse direction to the ion beam, for effecting selective deflection of the ions, in a defined transit time window, from the primary direction of the ion ray. It is thus possible to select the mass of the ions to be subjected to the secondary action through selection of the ion transit time.

According to certain embodiments of the invention, the transverse electric field is generated using a wire mesh. If a sufficiently fine Wire mesh is selected, then the action on the ion ray can be defined to very close space limits and in addition the secondary action can be time-modulated by varying the electric potential applied to the wire mesh.

According to one special embodiment of the invention, the wire mesh consists of two comb-like structures with teeth consisting of very fine wires, the teeth of the oppositely arranged comb-like structures engaging each other centrally, without however contacting each other, and all teeth of one comb-like structure are interconnected in an electrically conductive manner. In the case of such an arrangement, the electric fields produced by the two comb-like structures balance out each other already at very small distances before and behind the wire mesh so that any uncontrollable interference by undesirable effects on the ion ray by extensive fields of the type typical for conventional wire meshes can be excluded.

According to certain embodiments of the invention, the voltage pulses applied to the two comb-like structures are complementary, relative to the potential $U_o$ applied to the third diaphragm of the ion source, which means that they have identical amplitudes, identical pulse lengths, but opposite polarities. This permits either undesirable ion masses to be eliminated, or to open up a short time window to permit the passage of special ions, for example for the purpose of defined additional secondary fragmentation.

According to other embodiments of the invention, the secondary interaction at the space focus can be effected by optical excitation, in particular by means of a laser beam. It is possible in this way to effect photo dissociation, followed by subsequent fragmentation of the primary ions. Optical excitation provides the advantage that the process can be tuned very exactly to a specific electronic transition and, thus, to an extremely high mass selectivity. In addition, this "soft" excitation method is a particularly gentle process which permits even metastable states of larger molecules to be excited without destroying them before. On the other hand, this process allows the fragmentation to be varied between very soft and very hard and, consequently, the variation of the secondary mass spectra.

According to other embodiments of the invention, the secondary interaction at the space focus is effected by ion collision excitation, the impacting particles having their origin either in an electron ray or in an additional ion ray crossing the space focus in a direction perpendicular to the ray axis of the primary ions. The generation of an electron beam is particularly simple; it can be achieved at low cost and does not require any expensive lens systems. On the other hand, a second ion ray permits physical dispersion experiments to be carried out at the space focus. As in the case of photon excitation, impact excitation also permits the primary ions to be either transferred into an excited state or, if sufficient impact energy is supplied, to be broken into smaller molecular fractions.

According to certain embodiments of the invention, action is taken on the ions by means of pulses which, due to their short lengths, ensure very defined selection of the primary ions to be influenced, with respect to time, energy and, thus, mass. According to other embodiments of the invention, the pulse length may, however, be practically infinite in which case, however, the selection of the primary ions to be excited is controlled, due to the sharply defined energy of the exciting particles or photons, by exciting very specific energy levels of the electron envelope of these ions.

According to another embodiment of the invention, an additional action is taken on the physical state of the ions in the area of the space focus, which action may either consist in optical excitation of the ions by means of a laser ray, or in collision excitation using an electron ray, an additional ion ray or an atomic or molecular ray. This permits to record secondary mass spectra of very specific ion masses which have been selected before at the space focus, by a first interaction. Conversely, it is, however, also possible according to another embodiment of the invention, to arrange the point of interaction of the primary ion ray in an collision gas chamber, before the point of interaction at the space focus. By displacing the time window selected at the space focus successively relative to the time of generation of a primary ion pulse in the ion source, it is then possible to record a secondary mass spectrum of the ions leaving the collision chamber.

According to another embodiment of the invention, the point of secondary acceleration of the ions is arranged after the space focus. This permits to balance out partly the drastic loss in kinetic energy of the ion fractions encountered following fragmentation, which would have a negative influence on the mass resolution of the spectrometer. According to a special embodiment of the invention, a fourth diaphragm is provided in the ion ray following the space focus, which fourth diaphragm is electrically connected to the third diaphragm of the ion source by a tubular shield enclosing a field-free space. Secondary acceleration is then effected by a fifth diaphragm which is arranged on the axis of the ion beam downstream of the fourth diaphragm, viewed in the direction of flight of the ions, and which is connected to the mass potential of the time-of-flight spectrometer.

According to a preferred embodiment of the invention, the zone of secondary action is followed by an ion reflector comprising a reflector end plate and a plurality of retarding electrodes arranged in front of such end plate on a common axis of symmetry and at a certain distance therefrom and defining a retarding field, the reflector end plate being arranged for displacement along the axis of symmetry of the ion reflector and the electric potential applied to it being adjusted, every time the reflector end plate is displaced, so that the electric field strength prevailing between the reflector end plate and the adjacent retarding electrode is maintained unchanged. Such an ion reflector serves in the first place for compensating the time-off-light differences between ions of the same mass, but of different initial energies, and, consequently, to improve the mass resolution obtained. The movable end plate enables the ions of the primary ray to be screened out: These ions have a higher kinetic energy than all fragmentary ions obtained from the primary ions by the secondary action so that the depth of penetration into the ion reflector is the greatest for these primary ions. If, therefore, the reflector end plate is displaced toward the arriving ion beam until the primary ions just hit upon the plate, thereby being eliminated from the ion beam, then the ion reflector will be left only by the low-energy secondary ions produced by the secondary action. They can then be detected, undisturbed by the relatively high intensity of the primary ray, with high resolution. By moving the reflector end plate closer to the last retarding electrode, it is also possible to screen out ions of lower kinetic energy. This mode of operation, therefore, permits the ion reflector to be used as energy selector for recording secondary mass spectra.

The automatic adjustment of the electric potential at the reflector end plate, for any displacement of the latter, is achieved in the most simplest of all cases by a sliding contact. According to another embodiment of the invention, an electronic voltage control system is provided. A still other embodiment of the invention uses an electronic circuit which adjusts the potentials of the other retarding electrodes and of the reflector end plate every time the electric potential applied to any of the retarding electrodes is varied, in such a way that the original relationships between the different potentials existing before such variation remain unchanged. This guarantees that once the best possible adjustment of the ion reflector has been found, it will always and automatically be maintained, even if the position of the reflector end plate should be varied.

According to certain embodiments of the invention, each of the diaphragm apertures of the ion retarding electrodes is provided with a mesh or grid serving as potential shielding and for producing parallel equipotential surfaces. According to other embodiments of the invention, a preliminary diaphragm having a larger aperture diameter than the retarding electrodes is provided instead of the meshes or grids. The preliminary diaphragm is then connected to the mass potential of the time-of-flight mass spectrometer and permits to control the extension of the electric fields from the retarding electrodes into the space before the ion reflector and, thus, to take controlled influence on the ions arriving in and departing from the ion reflector.

Normally, the ions are deflected by the ion reflector from their original direction of flight by an angle of more than 90°, but less than 180°. According to one embodiment of the invention, however, the axis of symmetry of the ion reflector is colinear to the direction of flight of the arriving ions, which means that the ion ray is reflected in its direction of arrival. The ion detector is located in this case on the axis of the ion ray, between the ion reflector and the ion source, and comprises a concentric passage opening for the arriving ions, relative to the axis of the ion ray. This arrangement allows a very compact design of the time-of-flight mass spectrometer.

According to another embodiment of the invention, optimum time focussing is achieved for ions with less than the mean kinetic energy of the ions, by reducing the potential applied to the retarding electrodes and the reflector end plate. It is possible in this way, by tuning of the fields and observation in a fixed time window, to produce a secondary mass spectrum, in particular for molecule ions which have been fragmented on their trajectory.

Figure 3A:
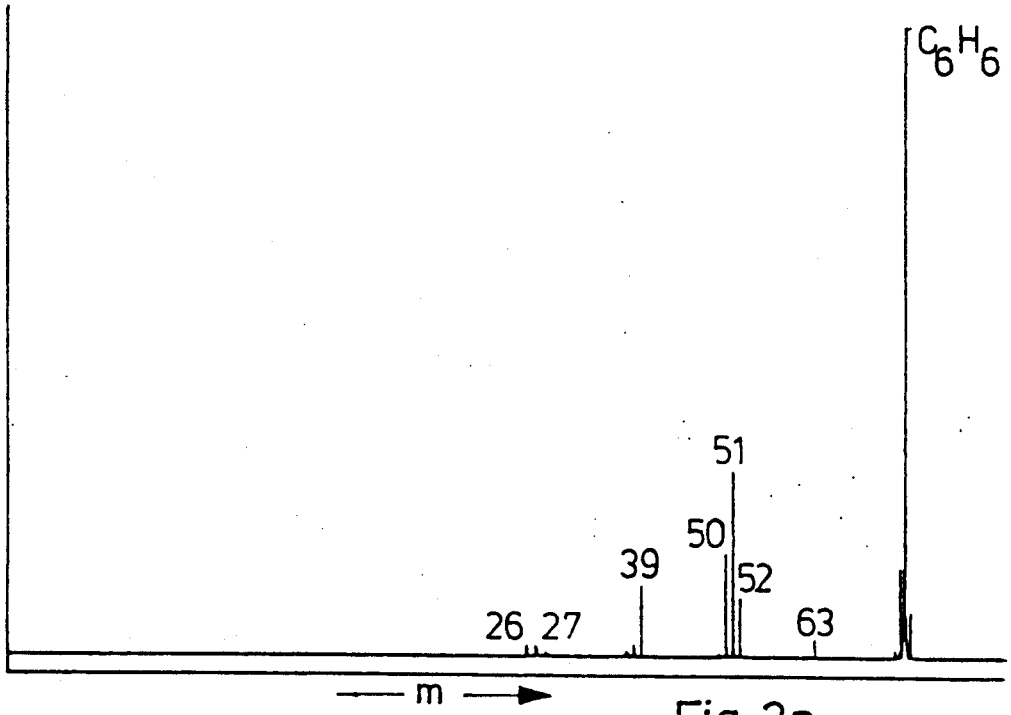
Figure 3B:
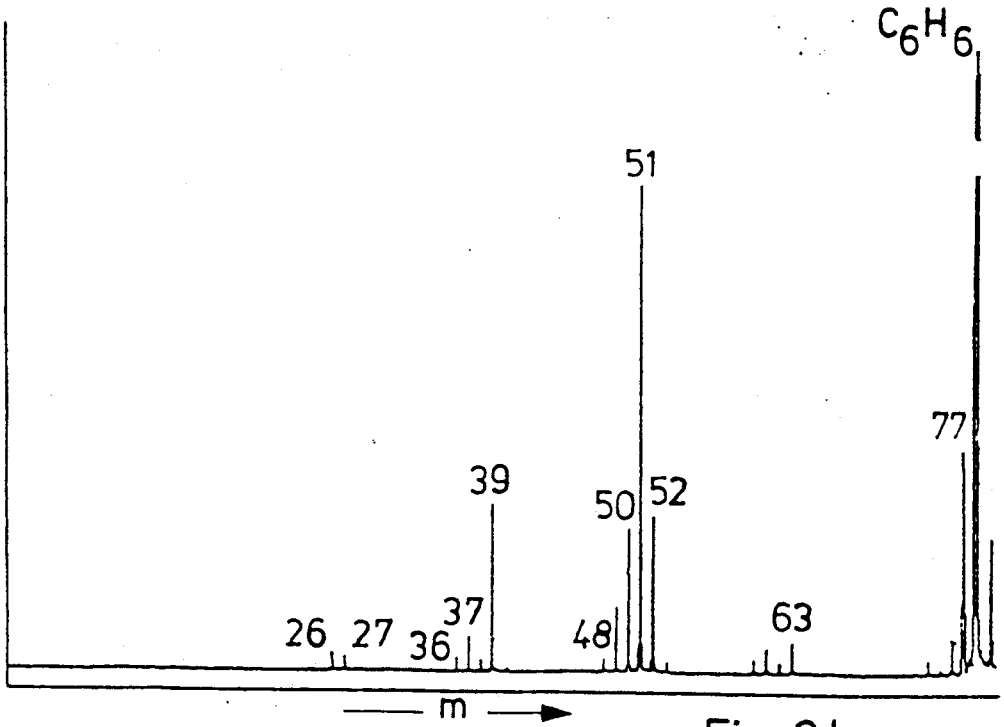
Figure 3C:
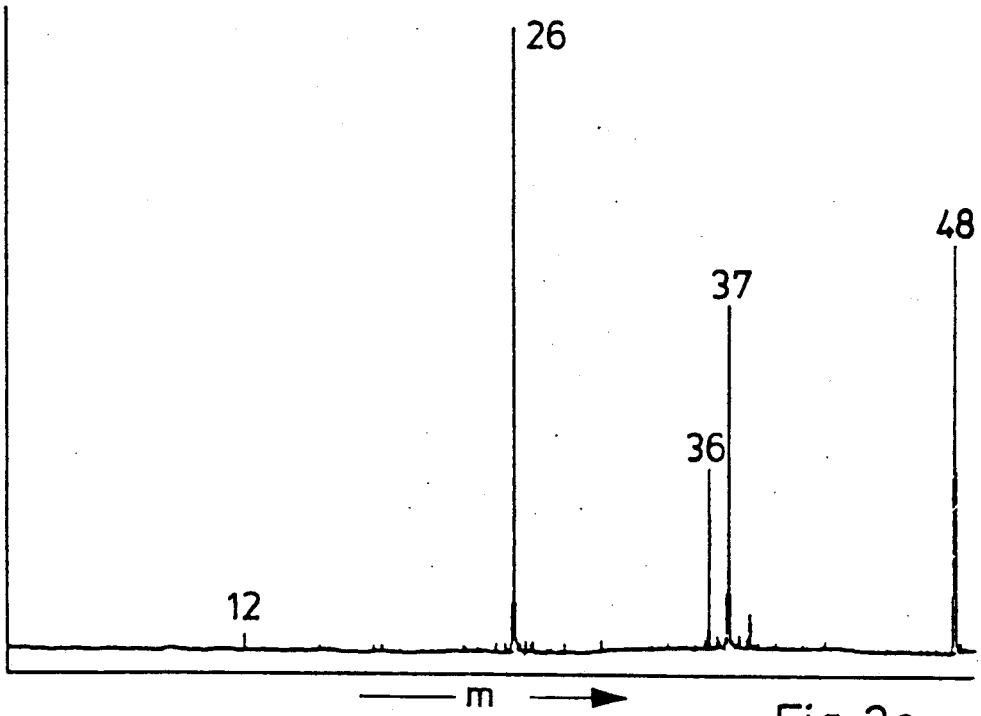
Figure 3D:
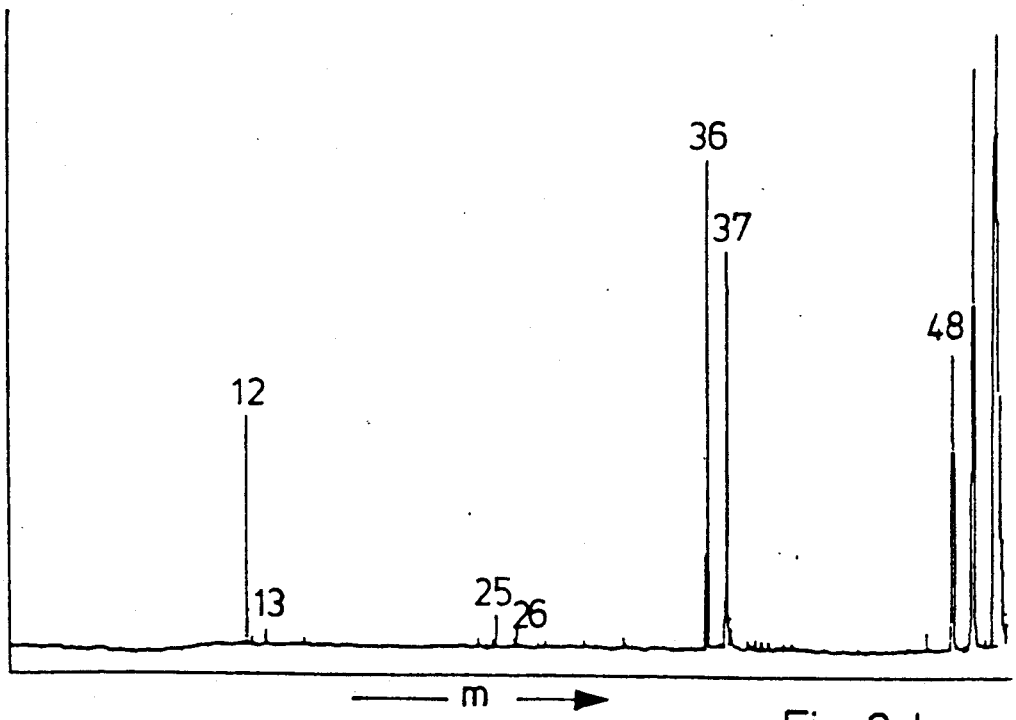
Figure 4A:
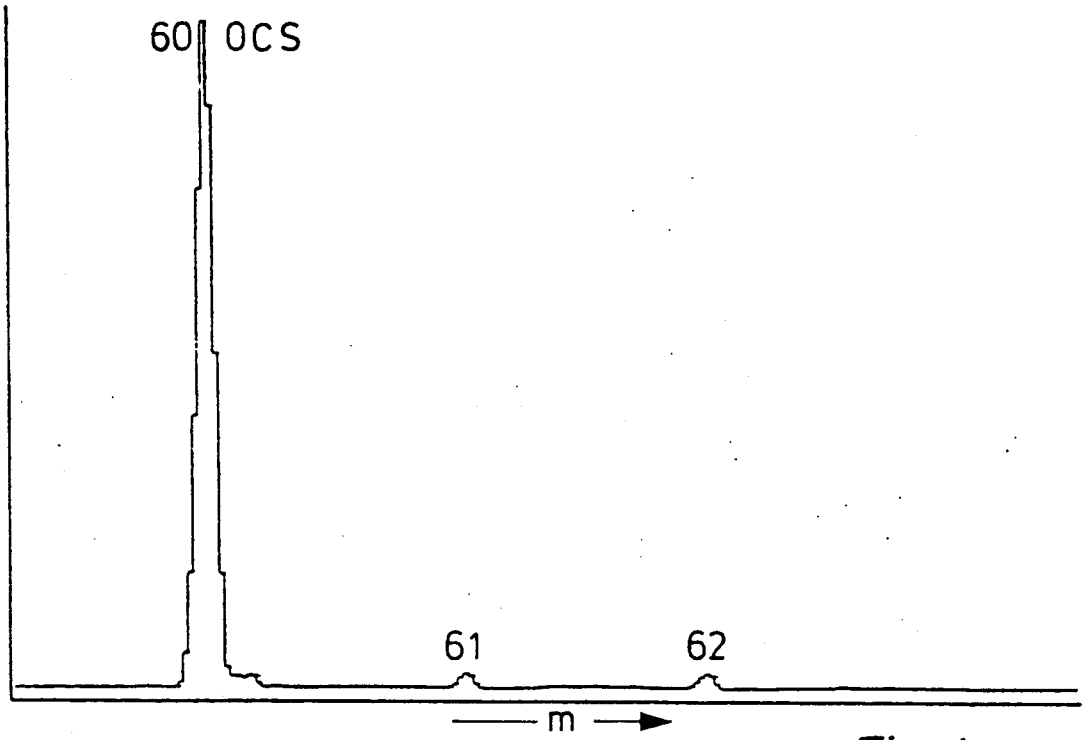
Figure 4B:
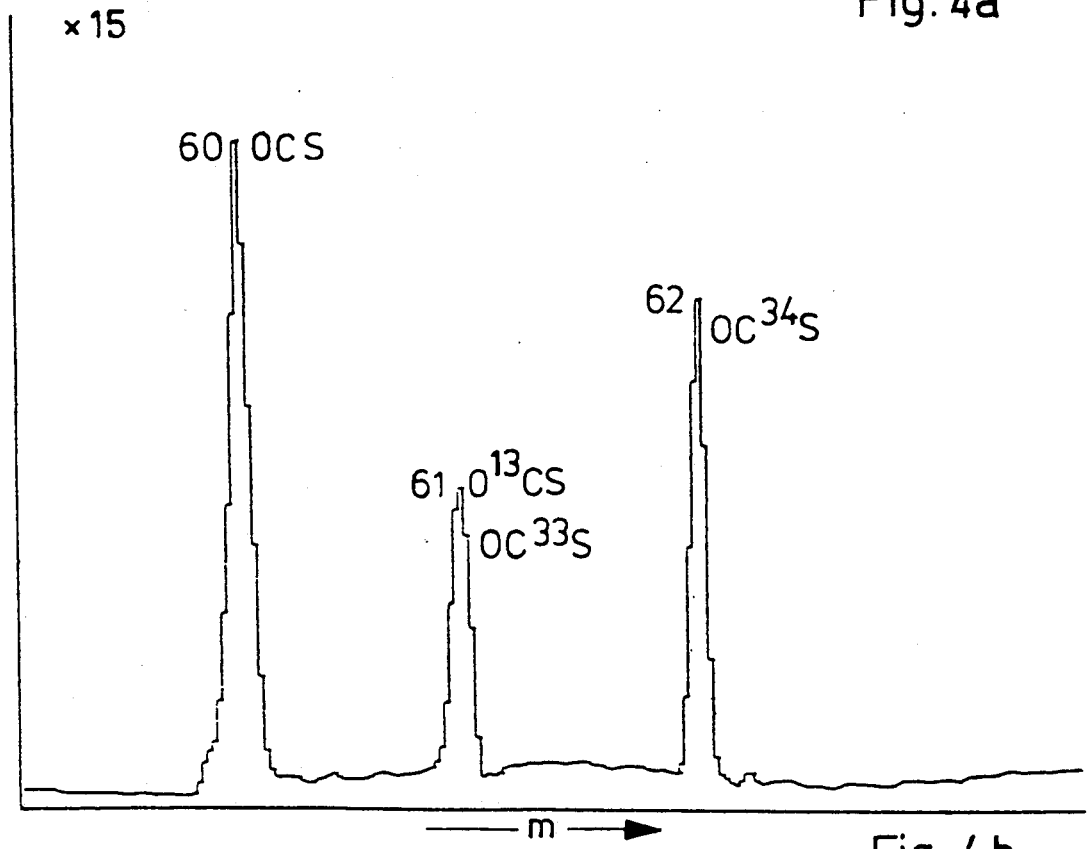

The invention will now be described and explained in more detail by way of certain embodiments illustrated in the drawing, it being understood that the features that can be derived from the specification and the drawing may be used in other embodiments of the invention either individually or in any combination thereof. In the drawing FIG. 1 shows a diagrammatic representation of the time-of-flight mass spectrometer according to the invention, comprising an ion source, a secondary interaction zone, an ion reflector and a fieldless ion drift trajectory with detector;

FIG. 2*a* shows a diagrammatic representation of one embodiment of the secondary interaction zone, using a laser or particle ray;

FIG. 2*b* shows a diagrammatic representation of one embodiment of the secondary interaction zone, using two comb-like structures forming a wire mesh at the space focus;

FIG. 2*c* shows the pulse diagram of the voltage pulses applied to the comb-like structures for eliminating a primary mass; FIG. 2*d* shows the pulse diagram of the voltage pulses applied to the comb-like structures, for transmission of a primary mass;

FIG. 2*e* shows a diagrammatic representation of one embodiment of the invention with shielded secondary interaction zone, double secondary interaction and a post-acceleration device for the secondary ion ray;

FIG. 3*a* shows a primary mass spectrum obtained by laser ionization of $C_6H_6$;

FIG. 3*b* shows a secondary mass spectrum obtained by secondary laser excitation of the primary $C_6H_6$ ion of the mass 78;

FIG. 3*c* shows a secondary mass spectrum obtained by secondary laser excitation of the primary $C_4H_4$ ion of the mass 52;

FIG. 3*d* shows a secondary mass spectrum obtained by secondary laser excitation of the primary $C_4H_2$ ion of the mass 50;

FIG. 4*a* shows a primary mass spectrum obtained by laser ionization of OCS, without secondary interaction at the space focus; and FIG. 4*b* shows a primary mass spectrum of OCS, enlarged 15 times compared with FIG. 4*a*, with secondary elimination of OCS of the mass 60, by pulses applied to the wire mesh at the space focus.

The MS-MS time-of-flight mass spectrometer illustrated diagrammatically in FIG. 1 comprises an ion source A, a secondary interaction zone B, an ion reflector C by which the incoming ion ray is reflected by an angle of more than 90°, as well as a field-less ion drift trajectory D with an ion detector 10 for detecting the ions. All these components are arranged within a housing—not shown in the drawing—arranged for being evacuated.

The ion source A comprises at least two accelerating pulsed or unpulsed electric fields which are generated by at least three diaphragms: an ion-repelling first diaphragm 1, an ion-attracting second diaphragm 2 and a post-accelerating third diaphragm 3. The diaphragms 2 and 3 are provided each with a passage opening for the accelerated ions. Separately adjustable potentials can be applied to each of the three diaphragms, i.e. a potential $U_1$ to the first diaphragm 1, a potential $U_b+U_o$ to the second diaphragm 2, and a potential $U_o$ to the third diaphragm 3. In the embodiment illustrated in FIG. 1, $U_o$ is identical to the mass potential of the set-up. An atomic or molecular ray 4 present between the diaphragms 1 and 2 may be directed either perpendicularly to the axis of symmetry 20 of the diaphragm arrangement, as illustrated in FIGS. 1 and 2e, or colinearly thereto. In the latter case, the first diaphragm 1 must also comprise a passage opening for the neutral molecules. In the case of the other embodiments, the particles to be ionized are produced by the introduction of gas into the ion source, or by vaporization of the particles in the ion source.

Ionization of the particles to be examined in the ion source is effected, in the case of the embodiments illustrated in FIGS. 1 and 2e, by a ray 5 which is introduced in a direction perpendicular to the axis of symmetry 20 of the diaphragm arrangement, between the first diaphragm 1 and the second diaphragm 2, at a distance a from the second diaphragm 2. The ray 5 may be either a laser ray, or an electron ray or an ion ray. Depending on the ray used, ionization of the particles to be examined is then effected either by absorption of the photon energy in the electron envelope or by particle collision. In other embodiments of the invention, a ray of incoherent light, in particular one emitted by a UV source, is used instead of the laser ray. In the embodiment illustrated in the drawing, the ionizing ray 5 crosses the ray 4 of the particles to be ionized in perpendicular direction, relative to the axis of symmetry 20, and is focussed on the crossing point. The pulsating behavior of the primary ion ray 25 generated in the ion source is produced by a correspondingly pulsed ionizing ray 5. According to other embodiments of the invention, however, the ionizing ray 5 may be irradiated continuously over time, and the pulsating behavior of the primary ion ray 25 may then be produced by pulsed electric fields generated by applying corresponding potentials to the diaphragms 1. 2, 3. In still other embodiments of the invention, ionization of the particles to be examined is effected by strong electric fields.

The point of origin of the primary ions, which in the illustrated embodiment is located on the axis of symmetry 20 between the first diaphragm 1 and the second diaphragm 2, at a distance a from the second diaphragm 2, can be varied by corresponding parallel displacement of the rays 4 and 5. The spacing b between the diaphragms 2 and 3 is fixed in the illustrated embodiment, but may be variable in other embodiments, for example due to a second diaphragm 2 that can be displaced in parallel, in which case the spacing a between the place of origin of the primary ions and the second diaphragm 2 will of course also vary correspondingly.

It is a common essential feature of all embodiments of the present invention that they all make use of the known fact that ion sources with pulsed ion generation have a so-called space focus which in the illustrated embodiment is located on the axis of symmetry 20 of the diaphragm arrangement, at a distance c following the third diaphragm 3, viewed in the direction of the primary ion ray 25.

The space focus 30 is the point where all ions of the same mass arrive at the same time, even though they may have been generated at the same time, but at different points in the ion source a and, consequently, may have been imparted different potential energies. The space focus 30, therefore, is a point in space where optimum energy correction is obtained. The order and, thus, the quality of this correction depends on the type of ion source employed. A single-stage ion source (using only diaphragms 1 and 2) permits a correction of the first order, while a two-stage ion source (as the one described above) permits a correction of the second order. Heretofore, only the space focus of the first order has been observed, even for multi-stage ion sources. The present invention is the first to make use of the space focus of the second order which will be derived hereafter:

The total time of flight $t_{ges}$ of the ions from the point of generation of the ions to the space focus 30 is equal to:

$$t_{ges}=t_a+t_b+t_c, \text{ wherein}$$

$$t_a=2a/v_a,\ t_b=2b/(v_a+v_b),\ t_c=c/v_b, \text{ and wherein}$$

$$v_a=(2qU_a/m)^{\frac{1}{2}},\ v_b=(2q(U_a+U_b)/m)^{\frac{1}{2}},$$

q being the electric charge of the ions and m being their mass.

A lack of definition in energy present at the point of generation of the ions leads to a lack of definition in the times of flight which can be avoided largely by an energy correction at the space focus 30. In order to define the condition for such a correction, the time of flight $t_{ges}$ is expanded into the initial energy uncertainty, which can be described by expansion of the potential $$U_a=U_a(exact)\cdot(1+x) with\ x<<1.$$

The uncertainty $x=x_o+x_k$ includes both the uncertainty $x_o$ resulting from the geometrical uncertainty at the place of generation of the ions and the uncertainty of the initial kinetic energy of the ions. In addition to the energy uncertainty, the latter term ($x_k$) also contributes to a certain time uncertainty ("turn around time") which has to be considered separately. The expansion into x finally results in:

$$\begin{aligned} t = {} & A(2a + 2b\cdot C(B^{-1/2} - 1) + c\cdot B^{1/2}) \pm 2A\cdot x\cdot x_k^{1/2} + \\ & +A\cdot x/2(2a + 2b\cdot C(B^{1/2} - 1) - c\cdot B^{3/2}) + && \text{1st order} \\ & -A\cdot x^2/8(2a + 2b\cdot C(B^{3/2} - 1) - 3c\cdot B^{5/2}) + && \text{2nd order} \\ & +A\cdot x^3/16(2a + 2b\cdot C(B^{5/2} - 1) - 5c\cdot B^{7/2}) + && \text{higher order} \end{aligned}$$

wherein $A=(m/(2qU_a))^{\frac{1}{2}}$, $B=U_a/(U_a+U_b)$, $C=U_a/U_b$. For a correction of the second order, both the term of the first order and the term of the second order must be eliminated from the above equation. This condition leads to the following equations for the values a, b, and c (see FIG. 1) and the potentials at the place of generation of the ions ($U_a+U_b$) and at the second diaphragm 2 ($U_b$):

$$a=\{c\cdot[(c-2b)/3c]^{3/2}+b\}\cdot(c-2b)/2(c+2b) \quad \text{(I)}$$

$$U_b/(U_a+U_b)=(2c+2b)/3c \quad \text{(II)}$$

While the distance between the place of generation of the ions and the space focus is fixed for a single-stage ion source (for example b=O, c=2a in FIG. 1), it can be varied within very wide limits for a two-stage ion source. A very advantageous solution is obtained when the space focus 30 is moved away from the ion source A as far as possible, i.e. when the longest possible trajectory c is selected. A long trajectory c (for example 10 to 20 cm) leads already to notable differences in the time of flight of the various masses. Combined with a space focussing step of the second order, such a space focus 30, therefore, already permits to achieve a mass resolution of 500 to 1000.

If a=0.85 cm, b=1 cm, c=10 cm, the kinetic energy of the ions =400 eV, the ion mass =100 amu, the resulting time of flight is $t_{ges}$=approx. 5 μsec. For a pulse width of the exciting ray 5 of Dt=5nsec, the resolution value obtained is $R=\frac{1}{2}\cdot t/Dt=500$, while for Dt=2nsec, the same value is R=1250. Even in the latter case, the energy correction of the second order still leads to low Dt values for the ion pulse widths and does not, therefore, limit the resolution.

It is a common feature of all embodiments of the time-off-light mass spectrometer according to the invention that such a space focus of the second order is produced by suitable selection of the diaphragm spacings in the ion source A and by the application of suitable potentials $U_1$, $U_b$ and $U_o$ to the diaphragms 1, 2, 3. In order to permit the space focus 30 to be adjusted exactly to a defined spacing c, which adjustment can be effected by varying the spacing a between the place of generation of the ions and the second diaphragm 2 and by varying the potentials applied to the diaphragms 1 and 2, there is provided a suitable ion detector 11 with plane impact surface. Thanks to mechanical sliding means, this detector can be moved into the ion trajectory of the primary ion ray 25 and retracted again from this position for the MS-MS measurements.

The automatic adjustment of the potential $U_b$, according to equation (II.), for a given potential $U_1$ and given spacings a, b, c, is effected by an electronic control system not shown in the drawing.

The ion reflector C illustrated in FIG. 1 comprises two stages, namely the retarding electrodes 6 and 7 defining a retarding field and the reflector end plate 8 which, together with the second retarding electrode 7—viewed in the direction of the arriving ion beam—defines a reflector field. In the embodiment illustrated in this figure, the retarding electrodes 6, 7 have the design of pinhole diaphragms. The arrangement of the reflector end plate 8 is such that it can be moved into and retracted from the reflector. In any such case, the potential applied to this end plate is automatically adjusted in such a way that the field strength between the retarding electrode 7 and the reflector end plate 8 remains unchanged. The retarding electrodes 6 and 7 are provided with an opening measuring several centimeters which may be provided with a grid for generating parallel equipotential surfaces; or else it can be operated without such grids, but then with a preliminary screen 9 connected to the apparatus mass of the time-of-flight mass spectrometer. The potentials required for such reflectors are in line with the values known from literature. The axis of symmetry 40 of the ion reflector C may extend at an angle —as illustrated in FIG. 1 —, or colinearly to the direction of flight of the ions. In the latter case, however, a special ion detector will be required (as will be explained further below).

The fieldless ion drift path D is obtained in a very simple manner by the arrangement of a sufficiently long, empty vacuum tube between a secondary interaction zone B and the ion reflector C, similar to known arrangements, except that a suitable ion detector 10 (for example a multi-channel plate detector) is arranged at the end of the ion trajectories, as close as possible to secondary interaction zone B. If the ion reflector C is one reflecting back in the direction of arrival, then the ion detector 10 is located on the axis of the incoming ion ray, and is provided in its central portion with a concentric passage opening for the ions arriving from the ion source A and the secondary interaction zone B.

The secondary interaction zone B includes the space focus 30; it is the core of the MS-MS time-of-flight mass spectrometer. In the case of the embodiment illustrated in FIG. *2a*, the focus 12 of a second laser pulse of a selected wave length and intensity is placed exactly on the space focus 30. The laser pulse may, however, also be replaced by other methods ensuring sharply defined local action (such as an electron ray). By varying the tie delay between the primary generation of ions in the ion source A and the secondary action at the space focus 30, the various, differently heavy ions are excited selectively, according to their different times of flight $t_{ges}$, so that they can be fragmented selectively by photo-electric dissociation. If only the pulse length is short enough and the focus 12 is small enough (for example 0.1 mm.), it is possible to achieve the maximum mass resolution possible at the space focus 30. The secondary interaction, therefore, is responsible for both the secondary mass selection and the secondary fragmentation.

With the ion reflector C corrected optimally to the kinetic energy of the primary ions contained in the ion ray 25, and the second laser switched off, a usual primary mass spectrum is obtained. In order to obtain a secondary mass spectrum of the ions selected by the secondary interaction, it is now necessary to continuously reduce the potential applied to the ion reflector C while maintaining the relationship between the potentials applied to the retarding electrodes 6, 7 and to the reflector end plate 8 (and the preliminary diaphragm 9, if any). The whole ion reflector C is now optimally corrected for decreasing ion energies. If fragmentation occurs in a fieldless space, the kinetic energy of a molecule ion is distributed among the fragments in proportion to their masses; secondary fragments of smaller masses are, therefore, imparted smaller kinetic energies. This means that the energy correction of the ion reflector is adjusted via decreasing of the secondary fragmentary ions. This means, however, that the secondary fragmentary ions of decreasing masses must arrive in succession at the ion detector 10, within a fixed time window. Now, if the signals of the ion detector 10 are recorded within this time window only, then one obtains a secondary mass spectrum of linear mass scale. All primary molecule and fragmentary ions have maximum kinetic energies so that they penetrate the farthest into the ion reflector C and may be eliminated from the mass spectrum by letting them hit against the reflector end plate 8 of the ion reflector C. To say it in other words: The ion reflector C, equipped with a movable reflector end plate 8 and a time window, has the function of a tunable energy analyzer and, considering what has been said above with respect to the fragment energies, the function of an analyzer for the masses of the secondary fragmentary ions.

FIGS. *3b–d* show such secondary mass spectra, with the intensity of the incoming ions, as measured by the ion detector 10, plotted against the coordinate and the potential of the reflector end plate 8, calibrated in ion masses m, plotted against the abscissa. FIG. *3a* shows a primary laser time-of-flight spectrum of benzene, where the intensity of the first laser has been selected in such a way that partial fragmentation of the benzene ions occurred in addition to the ionization. In FIG. *3b*, only the molecule ions in the space focus have been taken into consideration, excited and fragmented, by delaying the second laser in a suitable manner; the figure shows the secondary mass spectrum obtained. In FIG. *3c*, only the fragmentary ions $C_4H_4+$, in FIG. *3d* only the fragmentary ions $C_4H_2+$ have been fragmented selectively at the space focus 30. The secondary mass spectra of these two fragmentary ions differ drastically, this fact being due to different disintegration paths, in line with theoretical considerations. These temporary spectra already reach a resolution of the secondary mass spectra of R=600 although the latter had been limited by insufficient correction of the reflector and excessively big steps employed for varying the potentials at the ion reflector C.

In order to achieve optimum correction of the ion reflector C, and elimination of the primary ions, the movable reflector end plate 8 has been provided which enables the potentials at the ion reflector C to be adjusted to optimum energy correction: The reflector end plate 8 is then moved into the reflector field until the point of reversal of the primary ions coincides exactly with the reflector end plate 8. In order to leave the reflector field and, thus, the energy correction uninfluenced, the reflector end plate 8 must always be connected to a potential corresponding exactly to that of the equipotential surface of its respective position. This can be achieved, in certain embodiments of the invention, by a sliding contact not shown in the drawing or by an automatic electronic potential adjustment system.

It is then possible, also for secondary mass spectra, to achieve a resolution of 5000 and more, similar to the resolution achievable for primary mass spectra.

In the case of the embodiment of the invention illustrated in FIGS. *2b–d*, the secondary interaction is achieved by a special wire mesh 23, which is again arranged exactly at the space focus 30. The wire mesh 23 consists of two comb-like structures 13 and 14 whose "teeth" engage each other centrally without, however, contacting each other. The "teeth" consist of very fine wires, and all "teeth" belonging to one comb are interconnected electrically; they are spaced by 0.3 mm and less, and their spacing from the "teeth" of the other comb is 0.15 mm or less. Most favorably, the two combs are supplied with complementary voltage pulses ±U (same amplitude, same length, opposite sign). so that on the one hand any ions passing between the teeth at the correct moment will be subjected to a transverse electric field and be deflected laterally, while on the other hand the pulsed fields will balance out each other already at a very small distance from the wire mesh 23.

Voltage pulses of 5 nsec length and some 100 V are already sufficient to deflect the corresponding ions sufficiently so that they will no longer impinge upon the ion detector 10 which means that they are eliminated from the mass spectrum (FIG. *2c*). If, on the other hand, the two "combs" connected to different potentials +U and −U, respectively, are switched intermittently to identical potentials by a corresponding voltage pulse (FIG. *2d*), then those ions which are flying through the wire mesh 23 exactly at the moment of the pulse, will not be deflected and will be the only ones appearing in the mass spectrum. This permits on one hand, when mixtures are being analyzed, to eliminate undesirable ions (for example because of excessively high intensities), and on the other hand to select defined ions for additional secondary fragmentation. FIGS. *4a* and *b* show first results obtained with the aid of a prototype of the wire mesh 23 (spacing between neighboring "teeth": 1 mm and 0.5 mm, respectively; pulse length: 10 nsec, pulse level: 100 V), for $OCS^+$ and its $^{13}C$, $^{33}S$ and $^{34}S$ isotopes. The mass 60, which is by far the most frequent with 93.5% (FIG. *4a*), has been eliminated except for a residue of 6% (FIG. *4b*). It was not desirable, for the experiments in which these measurements were taken, to have the mass 60 eliminated completely, so that this figure is to be regarded only as a demonstration of the effects achievable.

The embodiment illustrated in FIG. *2e* is sort of a combination of the embodiments shown in FIG. *2a* and *2b*, respectively. The embodiment shown in FIG. *2a* enables a secondary mass spectrum to be obtained only sequentially, not by a single laser pulse. The embodiment illustrated in FIG. *2a* makes use of the fact that a two-stage ion reflector is capable of correcting an energy uncertainty as important as 20% in such a way that a mass resolution of 5000 can be achieved without any problem. In order to keep the loss in kinetic energy, which is encountered during ion fragmentation, within these limits one post-accelerates the fragmentary ions after the space focus 30. It is necessary for this purpose that the kinetic energy of the ions at the space focus 30 be equal to only a fraction of the final kinetic ion energy. To achieve this, one connects the ion source A, with the diaphragms 1, 2 and 3, the wire mesh 23 at the space focus 30 and an additional final fourth diaphragm 15 to a higher potential $U_o$. Post-acceleration then occurs between the fourth diaphragm 15 and a fifth diaphragm 16 connected to mass potential. The diaphragms 3 and 15 include between them a fieldless drift space with the space focus 30, shielded by a tube 17 connected to a potential identical to that of the diaphragms 3 and 15 and corresponding to the reference potential of the wire mesh 23.

If, for example, ions are generated at the potential 2000 V, and if the diaphragms 3 and 15 are connected to 1600 V (kinetic energy at the space focus: 400 eV), then the before-mentioned condition for high mass resolution is already fulfilled. The wire mesh 23 is arranged at the space focus 30, as in the case of the embodiment illustrated in FIG. *2b*, so that selected primary ions are selected with high mass resolution. A short way thereafter (for example 1 mm) the focus 18 of a second las-r or another pulsed interaction, for example an electron ray or an ion ray, is directed upon the ion ray leaving the wire mesh along the axis of symmetry 20. If the voltage pulse at the wire mesh 23 and the second laser pulse 18 or, in the case of certain embodiments of the invention, another interaction pulse are synchronized exactly with the time of flight of the primary ions of a defined mass to be examined then a secondary mass spectrum of these ions is obtained.

So, it is now possible to obtain a complete secondary mass spectrum with only a single ionization and fragmentation pulse. The movable reflector end plate 8 enables in addition all primary ions to be screened out.

According to certain other embodiments of the invention, the wire mesh 23 can be replaced by the laser focus 18 (or other pulsed interaction methods), although in this case metastable ion disintegrations occurring before the space focus 30 may disturb the secondary mass spectrum of the selected ion. When the wire mesh 23 is used, the secondary interaction may finally be of the continuous type, consisting for example of a continuous electron ray, a molecular or atomic ray or a collision gas chamber. It is then necessary, however that the latter be placed before the wire mesh, and the post-acceleration step be arranged as close as possible following the wire mesh.

in order to obtain improved mass resolution, certain embodiments of the invention provide that the secondary mass spectrum is subdivided into two or more mass ranges, in which case the energy correction of the reflector must be optimized to only one of these ranges, i.e. to an energy variation of only 10%, 5%, etc Post-acceleration between the diaphragms 15 and 16 can then be achieved with substantially lower potentials, as compared with the primary ion energy $U_a+U_b$.

Finally it is also possible to measure pure "metastable mass spectra". The term "metastable mass spectrum" as used herein is meant to describe the mass spectrum of all products of the metastable decomposition of a selected predecessor ion generated in the ion source. This metastable decomposition is induced in most of the cases by the additional excitation of the primary ions at the place of ionization, example by subsequent absorption of a photon of laser 1 in the primary ion. A further excitation, for example by laser 2, is then no longer necessary. Thus, only laser 2 is eliminated when recording "metastable mass spectra". Other wise, either the ion reflector potentials are screened off, or post-acceleration is used (entire "metastable mass spectrum" with a few or only one laser shots), all this in perfect analogy to the recording method for secondary mass spectra. However, when post-acceleration is used, only the products from decompositions occurring before the post-acceleration step will be detected. By extending the fieldless length between the ion source and the post-acceleration step, it is possible to enlarge this zone. Primary ions will be eliminated, also for "metastable mass spectra", by letting them impinge upon the ion reflector end plate. For further suppression of disturbing ions, for example products from metastable decompositions or other primary ions, use may be made of a wire-mesh deflection arrangement located near the space focus.

We claim:

1. A time-of-flight mass spectrometer comprising an ion source (A) for generating a pulsed primary ion beam (25), a device (B) for influencing the ions intermittently, in sharply defined areas, and an ion reflector (C) for balancing out time-of-flight differences between ions of identical mass, wherein the said ion source (A) is designed in such a way that all ions of the same mass, which are generated by the said ion source (A) at the same time, but at different points, and which therefore have different kinetic energies, arrive simultaneously at a space focus (30) of the 2nd order, wherein the said space focus (30) is equipped with means by which the physical state of the ions can be subjected intermittently to at least one of the following changes, namely change of the pulse, change of the quantum-mechanical state of the electron envelope, chemical reaction or fragmentation, so that a secondary ion beam with new physical properties is produced from the said primary ion beam (25), and wherein the design of the said ion reflector (C) is displaced such that operation in a corresponding mode will lead to secondary ions of the same mass being time-focused and the primary ions being screened out.

2. A method for generating a mass spectrum with the aid of a time-of-flight mass spectrometer according to claim 1, wherein at least partial fragmentation of the ions is effected by influencing the ions at the said space focus (30), wherein the position of the said reflector end plate (8) on the axis of symmetry (40) of the said ion reflector (C) is selected in a suitable way so that all arriving ions having a kinetic energy higher than a predetermined value, in particular the primary ions, are eliminated from the ion ray by letting them hit upon said the reflector end plate (8), and wherein the reflector potentials are varied in such a way that secondary fragmentary ions of decreasing or increasing masses are detected continuously in a fixed time window.

3. A time-of-flight mass spectrometer comprising an ion reflector (C), the said ion reflector (C) comprising a reflector end plate (8) and a plurality of retarding electrodes (6, 7) arranged in front of such end plate on a common axis of symmetry (40) and at a certain distance therefrom and defining a retarding field, wherein the said reflector end plate (8) is arranged for displacement along the axis of symmetry (40) of the said ion reflector (C) and wherein the electric potential applied to it is adjusted, every time the said reflector end plate (8) is displaced, so that the electric field strength prevailing between the said reflector end plate and the adjacent retarding electrode is maintained unchanged.

4. A time-of-flight mass spectrometer according to claim 3, wherein an electronic circuit is provided which, when the electric potential applied to one of the said retarding electrodes (6, 7) varies, adjusts the potentials of the remaining retarding electrodes (6, 7) and of the said reflector end plate (8) automatically in such a way that the original potential conditions prevailing before any such variation are maintained unchanged.

5. A method for generating a mass spectrum with the aid of a time-of-flight mass spectrometer according to claim 3, wherein at least partial fragmentation of the ions is effected by influencing the ions at the said space focus (30), wherein the position of the said reflector end plate (8) on the axis of symmetry (40) of the said ion reflector (C) is selected in a suitable way so that all arriving ions having a kinetic energy higher than a predetermined value, in particular the primary ions, are eliminated from the ion ray by letting them hit upon said the reflector end plate (8), and wherein the reflector potentials are varied in such a way that secondary fragmentary ions of decreasing or increasing masses are detected continuously in a fixed time window.

6. A time-of-flight mass spectrometer comprising an ion source (A) equipped with at least 3 diaphragms (1, 2, 3) having a common axis of symmetry (20) to which pulsed or time-constant electric potentials are applied, the ions being generated between the first diaphragm (1) repelling ions and the second diaphragm (2) attracting ions, at a spacing a from the said second diaphragm (2) smaller than the spacing between the said first (1) and the said second diaphragms (2), wherein the spacing a between the point of generation of the ions and the said second diaphragm (2), the spacing b between the said second diaphragm (2) and the said third diaphragm (3) post-accelerating the ions, the spacing c between the said third diaphragm (3) and a so-called space focus (30), namely a point in space located on the trajectory of the ions, after the said third diaphragm (3) in the direction of flight of the ions, and the relation of the potential difference $U_b$ between the said third diaphragm (3) and the said second diaphragm (2) to the potential difference $U_a+U_b$ between the said third diaphragm and the point of generation of the ions are selected in such a way that the conditions $$a=\{c\cdot[(c-2b)/3c]^{3/2}+b\}\cdot(c-2b)/2(c+2b)$$

$$\text{and } U_b/(U_a+U_b)=(2c+2b)/3c$$

are fulfilled.

7. A time-of-flight mass spectrometer according to claim 2, wherein the potentials applied to the said diaphragms (1, 2, 3, 15, 16) can be adjusted separately and the said spacing a can be adjusted by displacing an ionizing photon ray (5) and/or an atomic or molecular ray (4).

8. A time-of-flight mass spectrometer according to claim 2, wherein control means are provided for adjusting the potential $U_b$ prevailing at the said second diaphragm (2) automatically to given spacings a, b, c and a given potential $U_1$, existing at the said first diaphragm (1).

9. A time-of-flight mass spectrometer according to claim 2, wherein an ion detector 11) having a plane impact surface is provided in the path of movement of the ions at a distance c behind the said third diaphragm (3), viewed in the direction of flight of the ions, which can be moved out of the pat of movement of the ions by mechanical displacement means.

10. A time-of-flight mass spectrometer according to claim 2, wherein means are provided for influencing the ions at the said space focus (30) by pulses which are synchronized with the generation of the ion pulses in the said ion source (A), through a defined time delay.

11. A time-of-flight mass spectrometer according to claim 6, wherein a wire mesh (23) is provided by which the ions can be deflected, by an electric field built up in a direction transverse to the direction of the ion beam, and wherein the said wire mesh (23) consists of two comb-like structures (13, 14) with teeth consisting of very fine wires, the teeth of &he oppositely arranged comb-like structures (13 14) engaging each other centrally, without however contacting each other, and all teeth of one comb-like structure (13, 14) being interconnected in an electrically conductive manner.

12. A time-of-flight mass spectrometer according to claim 6, wherein a laser ray is provided for optical excitation of the electron envelope of the ions by means of photons and/or a particle ray is provided for collision excitation of the electron envelope of the ions for the purpose of fragmentation, the ray used for exciting the ions intersecting the primary ion ray (25) at the said space focus (30) at a right angle and/or being focused on the space focus (30).

13. A time-of-flight mass spectrometer according to claim 6, wherein a device serving to take an additional influence on the physical state of the ions by optical excitation of the ions by means of a laser ray or by collision excitation by means of an electron ray, and additional ion ray, an atomic ray or a molecular ray is provided behind the said space focus (30), viewed in the direction of movement of the ions.

14. A time-of-flight mass spectrometer according to claim 6, wherein a collision gas chamber is arranged before or behind the said space focus (30), viewed in the direction of movement of the ions.

15. A time-of-flight mass spectrometer according to claim 6, wherein a fourth diaphragm (15) is provided in the ion ray following the said space focus (30), coaxially to the said third diaphragm (3), wherein the said fourth diaphragm (15) is electrically connected to the said third diaphragm (3) by a shield (17), wherein a fifth diaphragm (16) is arranged after the said fourth diaphragm (15), viewed in the direction of movement of the ions, and the said fifth diaphragm (16) is connected to the mass potential of the time-of-flight mass spectrometer.

16. A method for generating a mass spectrum with the aid of a time-of flight mass spectrometer according to claim 2, wherein at least partial fragmentation of the ions is effected by influencing the ions at the said space focus (30), wherein the position of the said reflector end plate (8) on the axis of symmetry (40) of the said ion reflector (C) is selected in a suitable way so that all arriving ions having a kinetic energy higher than a predetermined value, in particular the primary ions, are eliminated from the ion ray by letting them hit upon said the reflector end plate (8), and wherein the reflector potentials are varied in such a way that secondary fragmentary ions of decreasing or increasing masses are detected continuously in a fixed time window.

* * * * *